US012139774B2

(12) United States Patent
Han et al.

(10) Patent No.: US 12,139,774 B2
(45) Date of Patent: Nov. 12, 2024

(54) SUSPENSION ROASTING SYSTEM AND METHOD FOR INDUSTRIAL PROCESSING OF IRON AND MANGANESE ORES

(71) Applicant: Northeastern University, Shenyang (CN)

(72) Inventors: Yuexin Han, Shenyang (CN); Shuai Yuan, Shenyang (CN); Yanjun Li, Shenyang (CN); Peng Gao, Shenyang (CN); Yongsheng Sun, Shenyang (CN)

(73) Assignee: NORTHEASTERN UNIVERSITY, Shenyang (CN)

( * ) Notice: Subject to any disclaimer, the term of this patent is extended or adjusted under 35 U.S.C. 154(b) by 0 days.

(21) Appl. No.: 18/712,175

(22) PCT Filed: Jun. 18, 2020

(86) PCT No.: PCT/CN2020/096751
§ 371 (c)(1),
(2) Date: May 21, 2024

(87) PCT Pub. No.: WO2021/237830
PCT Pub. Date: Dec. 2, 2021

(65) Prior Publication Data

US 2024/0327946 A1 Oct. 3, 2024

(30) Foreign Application Priority Data

May 29, 2020 (CN) ..... 202010473975.1

(51) Int. Cl.
*C22B 1/10* (2006.01)
*C21B 13/00* (2006.01)
(Continued)

(52) U.S. Cl.
CPC ..... *C22B 1/10* (2013.01); *C21B 13/0033* (2013.01); *C22B 1/24* (2013.01); *C22B 47/00* (2013.01)

(58) Field of Classification Search
None
See application file for complete search history.

(56) References Cited

U.S. PATENT DOCUMENTS 5,496,526 A * 3/1996 Pojar ..... C01G 49/0072 241/23
2018/0361395 A1* 12/2018 Han ..... C22B 1/02

FOREIGN PATENT DOCUMENTS

CN 101482021 A 7/2009
CN 101618887 A 1/2010
(Continued)

OTHER PUBLICATIONS

English translation of CN 108285973 (originally published Jul. 17, 2018) obtained from PE2E search.*
(Continued)

*Primary Examiner* — George Wyszomierski
(74) *Attorney, Agent, or Firm* — MUNCY, GEISSLER, OLDS & LOWE, P.C.

(57) ABSTRACT

A suspension roasting system includes a feeding bin, a Venturi dryer, a first cyclone preheater, a second cyclone preheater, a pre-oxidation suspension roasting furnace, a thermal separation cyclone cylinder, a suspension and reduction roasting furnace, a collecting bin, a grinding machine, a magnetic ore separator and a draught fan. A suspension roasting method includes: crushing iron and manganese ores; conveying the ores to the Venturi dryer; starting the
(Continued)

draught fan and enabling combustion gas in the Venturi dryer to be mixed with dust ores to remove water; enabling obtained solid materials to enter the pre-oxidation suspension roasting furnace after being preheated by the first and second cyclone preheaters; enabling obtained gas to enter the suspension and reduction roasting furnace through the thermal separation cyclone cylinder; performing suspension and reduction roasting; enabling obtained reducing slag powder to enter the collecting bin through cooling cyclone cylinders; and performing grinding and magnetic separation.

7 Claims, 2 Drawing Sheets

(51) Int. Cl.
*C22B 1/24* (2006.01)
*C22B 47/00* (2006.01)

(56) References Cited

FOREIGN PATENT DOCUMENTS

| | | | | |
|---|---|---|---|---|
| CN | 103725871 | A | | 4/2014 |
| CN | 104692435 | A | | 6/2015 |
| CN | 107460307 | A | | 12/2017 |
| CN | 107523685 | A | | 12/2017 |
| CN | 107760862 | A | | 3/2018 |
| CN | 108285973 | A | * | 7/2018 |
| CN | 108531719 | A | | 9/2018 |
| CN | 111074064 | A | * | 4/2020 |
| ZA | 9904062 | A | | 2/2000 |

OTHER PUBLICATIONS

English translation of CN 111074064 (originally published Apr. 28, 2020) obtained from PE2E search.*
Xiaolong Zhang et al., "Innovative utilization of refractory iron ore via suspension magnetization roasting: A pilot-scale study", Powder Technology, vol. 352, Apr. 17, 2019, 9 pages.

* cited by examiner

SUSPENSION ROASTING SYSTEM AND METHOD FOR INDUSTRIAL PROCESSING OF IRON AND MANGANESE ORES

BACKGROUND OF THE INVENTION

1. Field of the Invention

The present invention relates to the technical field of ore dressing, and more particularly to a suspension roasting system and method for industrial processing of iron and manganese ores.

2. The Prior Arts

Manganese is irreplaceable in the production process of high-property high-quality steel materials, 90% of the manganese is applied to steel industry, but at current, the proportion of high-quality iron mineral resources and manganese mineral resources is getting lower and lower. Besides, low-grade and polymetallic associated iron-manganese ore resources have not been developed and utilized. For example, iron and manganese ores are widely distributed and have huge reserves. But due to close relationship and similar nature of the iron and the manganese in ores, efficient utilization cannot be achieved by conventional ore dressing methods, and there is no economical and feasible resource utilization method.

Patent CN201410038273.5 discloses an additive and method for strengthening iron and manganese separation from high iron and manganese ores, the additive consists of sodium sulfate, sodium thiosulfate, sodium carbonate and sodium sulfide in a certain mass ratio; the method sequentially comprises the steps of agglomeration, drying, reduction roasting, enabling a roasted product to be crushed, ground, and magnetically separated after cooling to obtain metallic iron powder and non-magnetic substances rich in MnO; and the invention realizes iron and manganese separation, but needs to add a large quantity of additives, the cost is high, and introduction of a sulfide additive to produce $SO_2$ is more harmful to environment.

Patent CN200810246124.2 discloses an iron and manganese concretion ore dressing vehicle, when a magnetic rotating wheel rotates, minerals other than the iron and manganese ore are thrown out, and the iron and manganese ore is brought to an ore box. The invention has the notable effect that magnetism is used to attract the iron and manganese ore. Preliminary enrichment can be achieved by suction, but further recovery of iron minerals and manganese minerals cannot be achieved, and qualified final products of the iron minerals and the manganese minerals cannot be obtained.

It has important economic and social value to realize the resource utilization of the iron and manganese ore, obtain new technologies and industrialized equipment for final high-quality iron pre concentrate and manganese ore products, and complete the efficient and clean production of the iron and manganese ore.

SUMMARY OF THE INVENTION

Aiming at the technical problems of high energy consumption, low processing capacity, high cost, a large quantity of additives, environmental pollution and the like existing in utilization and development of existing traditional iron and manganese ores, the present invention is to provide a suspension roasting system and method for industrial processing of iron and manganese ores.

The suspension roasting system for industrial processing of iron and manganese ores comprises a feeding bin 2, a screw feeder 4, a Venturi dryer 5, a first cyclone preheater 6, a second cyclone preheater 7, a pre-oxidation suspension roasting furnace 8, a thermal separation cyclone cylinder 10, a first flow sealing valve 11, a suspension and reduction roasting furnace 12, a second flow sealing valve 14, a first cooling cyclone cylinder 15, a second cooling cyclone cylinder 16, a third cooling cyclone cylinder 17, a collecting bin 18, a grinding machine 19, a magnetic ore separator 20, a dust collector 23, a draught fan 26, a coal gas source 29 and a nitrogen gas source 30. An outlet of the feeding bin 2 is opposite to a feeding end of the screw feeder 4, and a discharging end of the screw feeder 4 is opposite to a feed opening of the Venturi dryer 5. A discharge opening of the Venturi dryer 5 communicates with a feed opening of the first cyclone preheater 6, a discharge opening of the first cyclone preheater 6 communicates with a feed opening of the second cyclone preheater 7, a discharge opening of the second cyclone preheater 7 communicates with a feed opening in a lower part of the pre-oxidation suspension roasting furnace 8, and a burner and an air inlet are arranged in a bottom part of the pre-oxidation suspension roasting furnace 8. An upper part of the pre-oxidation suspension roasting furnace 8 communicates with a first feed opening of the thermal separation cyclone cylinder 10 through a first pipeline, a discharge opening of the thermal separation cyclone cylinder 10 communicates with an inlet of the first flow sealing valve 11, an outlet of the first flow sealing valve 11 communicates with a first feed opening in a top part of the suspension and reduction roasting furnace 12, and a plurality of air inlets are formed in a bottom part of the suspension and reduction roasting furnace 12 and simultaneously communicate with the coal gas source 29 and the nitrogen gas source 30. A discharge opening in a side part of the suspension and reduction roasting furnace 12 communicates with an inlet of the second flow sealing valve 14, an outlet of the second flow sealing valve 14 communicates with a feed opening of the first cooling cyclone cylinder 15, a discharge opening of the first cooling cyclone cylinder 15 communicates with a feed opening of the second cooling cyclone cylinder 16, a discharge opening of the second cooling cyclone cylinder 16 communicates with a feed opening of the third cooling cyclone cylinder 17, and a discharge opening of the third cooling cyclone cylinder 17 communicates with an inlet of the collecting bin 18. An outlet of the collecting bin 18 cooperates with an inlet of the grinding machine 19, and an outlet of the grinding machine 19 cooperates with a feed opening of the magnetic ore separator 20. An air outlet of the first cyclone preheater 6 communicates with an air inlet of the dust collector 23, and an air outlet of the dust collector 23 communicates with the draught fan 26.

In the system, the system further comprises a feeding belt 1; wherein the feeding belt 1 is arranged above the feeding bin 2 to convey dust ores to the feeding bin 2.

In the system, the system further comprises a weight-loss feeder 3; wherein the weight-loss feeder 3 is arranged between the feeding bin 2 and the screw feeder 4, and is respectively opposite to the outlet of the feeding bin 2 and the feeding end of the screw feeder 4.

In the system, the system further comprises an air slider 24 and a chain bucket elevator 25; wherein a discharge opening of the dust collector 23 is opposite to the air slider 24, a discharge opening of the air slider 24 is opposite to an inlet of the chain bucket elevator 25, and an outlet of the chain bucket elevator 25 communicates with a second feed opening of the thermal separation cyclone cylinder 10; wherein an air outlet of the thermal separation cyclone cylinder 10 communicates with the feed opening of the second cyclone preheater 7; and wherein an air outlet of the second cyclone preheater 7 communicates with an air inlet in a bottom part of the Venturi dryer 5 through a second pipeline, a second additional burner 9-3 is arranged on the second pipeline, and the second additional burner 9-3 communicates with the coal gas source 29.

In the system, the system further comprises a cyclone separator 13; wherein an exhaust opening is formed in the top part of the suspension and reduction roasting furnace 12 and communicates with a feed opening in a bottom part of the cyclone separator 13, an air outlet of the cyclone separator 13 communicates with the feed opening in the lower part of the pre-oxidation suspension roasting furnace 8, and a discharge opening of the cyclone separator 13 communicates with a second feed opening in the top part of the suspension and reduction roasting furnace 12.

In the system, an air outlet of the third cooling cyclone cylinder 17 communicates with the feed opening of the second cooling cyclone cylinder 16, an air outlet of the second cooling cyclone cylinder 16 communicates with the feed opening of the first cooling cyclone cylinder 15, an air outlet of the first cooling cyclone cylinder 15 communicates with the air inlet in the bottom part of the pre-oxidation suspension roasting furnace 8, and an air inlet of the third cooling cyclone cylinder 17 is provided with an air pipeline for inflation of air 31.

In the system, the burner arranged at the bottom part of the pre-oxidation suspension roasting furnace 8 consists of a main burner 9-1 and a first additional burner 9-2; and wherein the main burner 9-1 and the first additional burner 9-2 respectively communicate with the coal gas source 29.

In the system, the system further comprises a chimney 27; wherein an outlet of the draught fan 26 communicates with a chimney 27.

In the system, the system further comprises an iron ore concentrate collector 21 and a manganese ore concentrate collector 22; wherein a magnetic product outlet of the magnetic ore separator 20 is opposite to the iron ore concentrate collector 21, and a nonmagnetic product outlet of the magnetic ore separator 20 is opposite to the manganese ore concentrate collector 22.

In the system, the system further comprises a plurality of couple temperature measurement devices and a plurality of pressure sensors, the couple temperature measurement devices are respectively arranged on the pre-oxidation suspension roasting furnace 8, the suspension and reduction roasting furnace 12 and the dust collector 23 and used for detecting temperature, and the pressure sensors are respectively arranged on the pre-oxidation suspension roasting furnace 8, the suspension and reduction roasting furnace 12 and the dust collector 23 and used for detecting pressure.

In the system, the system further comprises a plurality of couple temperature measurement devices and a plurality of pressure sensors, the couple temperature measurement devices are respectively arranged on the first cooling cyclone cylinder 15, the second cooling cyclone cylinder 16 and the third cooling cyclone cylinder 17 and used for detecting temperature, and the pressure sensors are respectively arranged on the first cooling cyclone cylinder 15, the second cooling cyclone cylinder 16 and the third cooling cyclone cylinder 17 and used for detecting pressure.

The suspension roasting method for industrial processing of iron and manganese ores with the system, comprises the following steps:

(1) Crushing iron and manganese ores until a total mass of a part with a grain size of 1 mm being greater than or equal to 80% to obtain dust ores, wherein an iron grade TFe of the iron and manganese ores is 30-55%, and a manganese grade TMn of the iron and manganese ores is 10-30%.

(2) Placing the dust ores in the feeding bin 2, then conveying the dust ores into the screw feeder 4, and continuously feeding the dust ores into the Venturi dryer 5 through the screw feeder 4.

(3) Starting the draught fan 26 to enable the dust collector 23, the first cyclone preheater 6, the second cyclone preheater 7, the Venturi dryer 5, the thermal separation cyclone cylinder 10 and the pre-oxidation suspension roasting furnace 8 to generate negative pressure, inflating combustion gas into the Venturi dryer 5, mixing the combustion gas with the dust ores, and removing adsorbing water of the dust ores; controlling a material temperature of the discharge opening of the Venturi dryer 5 to be 150-180° C.

(4) Enabling the combustion gas and the dust ores without the adsorbing water to enter the first cyclone preheater 6 from the Venturi dryer 5, enabling solid materials after cyclonic separation to enter the second cyclone preheater 7, preheating the solid materials after cyclonic separation for the second time in the second cyclone preheater 7 to 400-700° C., and then enabling the preheated solid materials to enter the pre-oxidation suspension roasting furnace 8.

(5) Starting the burner to burn inflated coal gas to generate high-temperature gas to enter the pre-oxidation suspension roasting furnace 8, while inflating air 31 into the pre-oxidation suspension roasting furnace 8 through the air inlet in the bottom part of the pre-oxidation suspension roasting furnace 8, under an action of air flow and negative pressure, enabling the solid materials in the pre-oxidation suspension roasting furnace 8 to be in a suspension state, heating the solid materials to 550-900° C. for roasting, enabling carbonate minerals in the solid materials to be subjected to thermal decomposition, and enabling manganese minerals and iron minerals to be subjected to an oxidizing reaction; enabling all roasted solid materials to be discharged from the upper part of the pre-oxidation suspension roasting furnace 8 along with the air flow through the first pipeline to enable the solid materials to enter the thermal separation cyclone cylinder 10; using the solid materials after cyclonic separation as oxidizing slag powder, discharging the solid materials from the thermal separation cyclone cylinder 10, and enabling the discharged solid materials to enter the suspension and reduction roasting furnace 12 through the first flow sealing valve 11.

(6) Inflating the coal gas and nitrogen gas from the air inlets in the bottom part of the suspension and reduction roasting furnace 12, enabling the oxidizing slag powder to be in a suspension state under an action of the air flow and the negative pressure, performing reducing roasting at 500-650° C., performing reduction on weakly magnetic $Fe_2O_3$ to generate strongly magnetic $Fe_3O_4$, and performing reduction on $Mn_2O_3$ to generate MnO; using the solid materials after reducing roasting as reducing slag powder, and discharging the reducing slag powder from the side part of the suspension and reduction roasting furnace 12.

(7) Enabling the reducing slag powder discharged from the suspension and reduction roasting furnace 12 to sequentially pass through the first cooling cyclone cylinder 15, the second cooling cyclone cylinder 16 and the third cooling cyclone cylinder 17 after entering the second flow sealing valve 14, performing cooling the reducing slag powder to be smaller than or equal to 200° C., and enabling the cooled reducing slag powder to enter the collecting bin 18.

(8) Conveying the reducing slag powder in the collecting bin 18 to the grinding machine 19, performing grinding until a part with a grain size of 0.074 mm accounts for 75-85% of a total mass, enabling the ground powder to enter the magnetic ore separator 20 for magnetic ore separation, and using magnetic products obtained by magnetic ore separation as iron ore concentrates and nonmagnetic products obtained by magnetic ore separation as manganese ore concentrates.

In the method, the step (2) further comprises the following steps: conveying the dust ores to the feeding bin 2 through a feeding belt 1.

In the method, the step (2) further comprises the following steps: continuously feeding the dust ores in the feeding bin 2 to the screw feeder 4 through a weight-loss feeder 3.

In the method, the step (4) further comprises the following steps: after the dust ores enter the first cyclone preheater 6, exhausting separated gas from the first cyclone preheater 6, enabling the exhausted gas to enter the dust collector 23, and enabling the gas after dust removal into the draught fan 26; after dust generated during dust removal is discharged, enabling the dust to enter a chain bucket elevator 25 through an air slider 24; conveying the dust to the thermal separation cyclone cylinder 10 through the chain bucket elevator 25; inflating the gas separated by the thermal separation cyclone cylinder 10 in a cyclonic separation process into the second cyclone preheater 7; inflating the gas separated by the second cyclone preheater 7 in a cyclonic separation process to enter the Venturi dryer 5 through a second pipeline; and enabling a second additional burner 9-3 arranged on the second pipeline to inflate the combustion gas into the Venturi dryer 5 at the same time.

In the method, the step (6) further comprises the following steps: inflating gas generated by the suspension and reduction roasting furnace 12 in a reducing roasting process into a cyclone separator 13 from an exhaust opening in the top part of the suspension and reduction roasting furnace 12, enabling the dust separated by the cyclone separator 13 to return to the suspension and reduction roasting furnace 12 through a second feed opening in the top part of the suspension and reduction roasting furnace 12, and inflating the separated gas by the cyclone separator 13 into the feed opening in the lower part of the pre-oxidation suspension roasting furnace 8.

In the method, the step (7) further comprises the following steps: inflating the gas separated by the third cooling cyclone cylinder 17 in a cyclonic separation process into the feed opening of the second cooling cyclone cylinder 16, inflating the gas separated by the second cooling cyclone cylinder 16 in a cyclonic separation process into the feed opening of the first cooling cyclone cylinder 15, inflating the gas separated by the first cooling cyclone cylinder 15 in the cyclonic separation process into the air inlet in the bottom part of the pre-oxidation suspension roasting furnace 8, while inflating air 31 through an air inlet of the third cooling cyclone cylinder 17.

According to the method, the step (5) further comprises the following steps: the burner arranged at the bottom part of the pre-oxidation suspension roasting furnace 8 consists of a main burner 9-1 and a first additional burner 9-2, wherein coal gas is inflated into the main burner 9-1 and the first additional burner 9-2 through the coal gas source 29.

According to the method, the step (6) further comprises the following steps: inflating coal gas and nitrogen gas from the air inlets in the bottom part of the suspension and reduction roasting furnace 12 through the coal gas source 29 and the nitrogen gas source 30.

According to the method, the step (4) further comprises the following steps: exhausting gas 28 exhausted by the draught fan 26 through chimney 27.

According to the method, the step (8) further comprises the following steps: the magnetic products separated by magnetic ore separation enter an iron ore concentrate collector 21, and the nonmagnetic products separated by magnetic ore separation enter a manganese ore concentrate collector 22.

According to the method, a plurality of couple temperature measurement devices are respectively arranged on the pre-oxidation suspension roasting furnace 8, the suspension and reduction roasting furnace 12 and the dust collector 23 and used for detecting temperature, and a plurality of pressure sensors are respectively arranged on the pre-oxidation suspension roasting furnace 8, the suspension and reduction roasting furnace 12 and the dust collector 23 and used for detecting pressure.

According to the method, a plurality of couple temperature measurement devices are respectively arranged on the first cooling cyclone cylinder 15, the second cooling cyclone cylinder 16 and the third cooling cyclone cylinder 17 and used for detecting temperature, and a plurality of pressure sensors are respectively arranged on the first cooling cyclone cylinder 15, the second cooling cyclone cylinder 16 and the third cooling cyclone cylinder 17 and used for detecting pressure.

According to the method, the step (5) further comprises the following steps: a residence time of the solid materials entering the pre-oxidation suspension roasting furnace 8, in the pre-oxidation suspension roasting furnace 8 is 60-300 seconds.

According to the method, the step (6) further comprises the following steps: a residence time of oxidizing slag powder in the suspension and reduction roasting furnace 12 is 10-70 minutes.

The coal gas is producer gas, coke oven gas, blast-furnace gas, converter gas or cracked natural gas.

According to the method, the step (6) further comprises the following steps: when the coal gas and the nitrogen gas are inflated from the air inlets in the bottom part of the suspension and reduction roasting furnace 12, the inflation amount of the coal gas is 1.1-1.3 times of a theoretically required amount for a complete reaction between $H_2/CO$ in the coal gas and $Fe_2O_3$ and $Mn_2O_3$ in the oxidizing slag powder, and a reaction formula on which the complete reaction is based on:

$Fe_2O_3+H_2/CO \rightarrow Fe_3O_4+H_2O/CO_2$ and $Mn_2O_3+H_2/CO \rightarrow MnO+H_2O/CO_2$;

and besides, a volume concentration of the coal gas in the pre-oxidation suspension roasting furnace 8 is controlled to be 20-40%.

According to the method, the step (8) further comprises the following steps: magnetic field strength during magnetic separation is 1000-2000 Oe.

The iron ore concentrates have a TFe grade of 65-68%, and the manganese ore concentrates have a TMn grade of 45-51%.

Compared with the current traditional ore dressing process and roasting process of iron and manganese ores, the system and the method disclosed by the present invention have higher heat and mass transfer efficiency, lower energy consumption, stronger adaptability to different types of the iron and manganese ores, and larger processing capacity, and are suitable for large-scale industrial production advantages.

DETAILED DESCRIPTION OF THE PREFERRED EMBODIMENT

A feeding belt, a weight-loss feeder, a screw feeder and a Venturi dryer used in the embodiments of the present invention are commercially available products.

An air slider and a chain bucket elevator used in the embodiments of the present invention are commercially available products.

A first cooling cyclone cylinder, a second cooling cyclone cylinder, a third cooling cyclone cylinder, a first cyclone preheater and a second cyclone preheater used in the embodiments of the present invention are all commercially available cyclone separators.

A dust collector used in the embodiment of the present invention is a commercially available bag dust collector.

Figure 2:
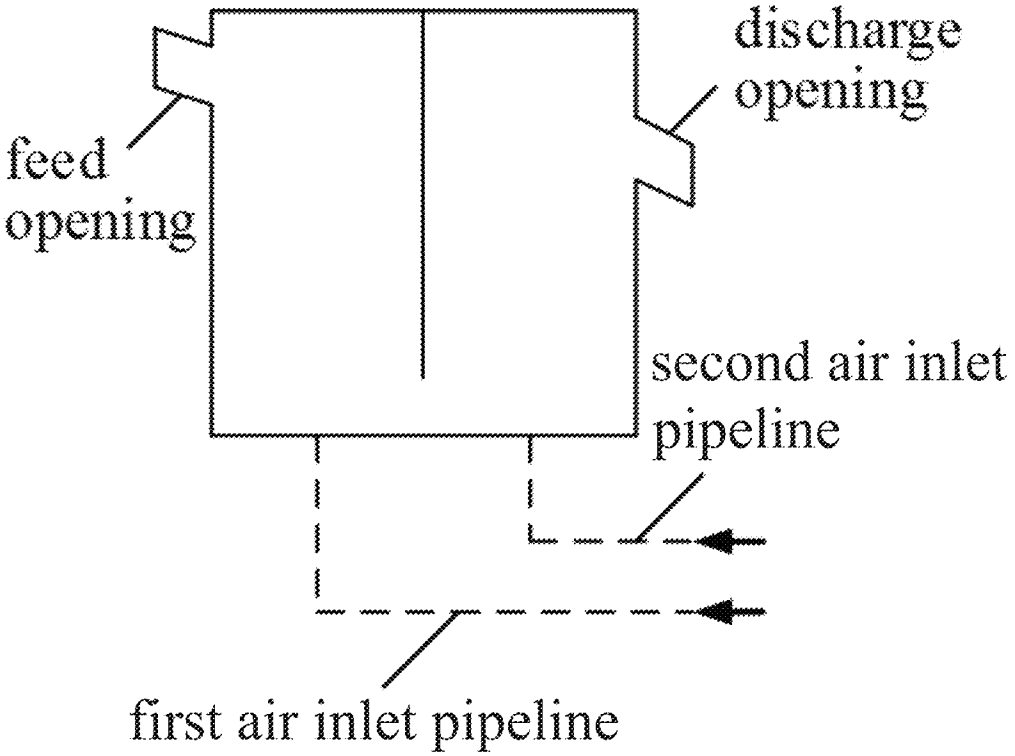
FIG. 2 is a schematic diagram of a structural principle of a flow sealing valve in the embodiment of the present invention.

The structural principles of the flow sealing valves used in the embodiment of the present invention are shown as FIG. 2, and baffles are arranged in the flow sealing valves to divide inner parts of the flow sealing valves into a feed chamber and a discharge chamber. The top and side edges of the baffles are fixedly connected with the inner parts of the flow sealing valves, and gaps are formed between the bottom edges of the baffles and the bottoms of the flow sealing valves to be used as horizontal channels. A feed opening is formed in a side wall of the feed chamber, a discharge opening is formed in a side wall of the discharge chamber, the feed opening and the discharge opening are both located above the bottom edges of the baffles, and the feed opening is higher than the discharge opening. A loosen air inlet is formed in a bottom plate of the feed chamber and communicates with an first air inlet pipeline, and a fluidized air inlet is formed in a bottom plate of the discharge chamber and communicates with an second air inlet pipeline. The first air inlet pipeline and the second air inlet pipeline communicate with the gas sources.

A working method of the flow sealing valves in the embodiments of the present invention comprises the following steps: solid materials entering from the feed opening gradually accumulate, when the solid materials close the horizontal channel, gas is inflated into the feed chamber through the first air inlet pipeline as loose air, and gas is inflated into the discharge chamber through the second air inlet pipeline as fluidized air, so that the solid materials in the feed chamber move to the discharge chamber under an action of air flow; and along with gradual accumulation of the solid materials in the feed chamber and the discharge chamber, when top surfaces of the solid materials in the discharge chamber rise to a position of the discharge opening, the solid materials in the discharge chamber are discharged from the discharge opening under the action of the air flow.

According to the embodiment of the present invention, the first air inlet pipeline and the second air inlet pipeline respectively communicate with a nitrogen gas source, and nitrogen gas is used as the loose air and the fluidized air.

According to the embodiment of the present invention, a plurality of couple temperature measurement devices are respectively arranged on a pre-oxidation suspension roasting furnace, a suspension and reduction roasting furnace and a dust collector are used for detecting temperature, and a plurality of pressure sensors are respectively arranged on the pre-oxidation suspension roasting furnace, the suspension and reduction roasting furnace and the dust collector and used for detecting pressure.

According to the embodiment of the present invention, a plurality of couple temperature measurement devices are respectively arranged on a first cooling cyclone cylinder, a second cooling cyclone cylinder and a third cooling cyclone cylinder and used for detecting temperature, and a plurality of pressure sensors are respectively arranged on the first cooling cyclone cylinder, the second cooling cyclone cylinder and the third cooling cyclone cylinder and used for detecting pressure.

According to the embodiment of the present invention, the coal gas is producer gas, coke oven gas, blast-furnace gas, converter gas or cracked natural gas.

Embodiment 1

Figure 1:
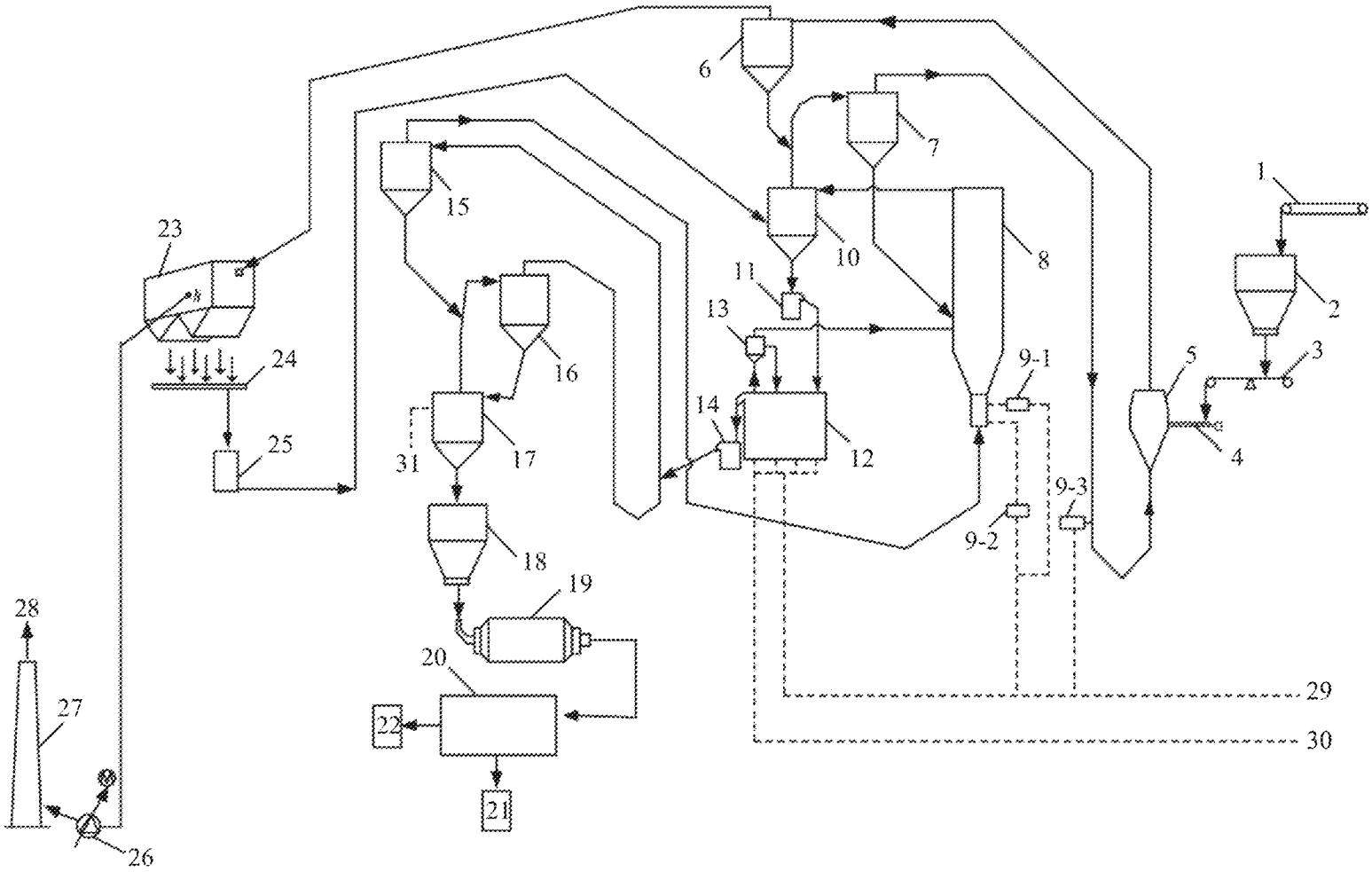
FIG. 1 is a schematic structural diagram of a suspension roasting system for industrial processing of iron and manganese ores in the embodiment of the present invention; and In drawings, 1: feeding belt; 2: feeding bin; 3: weight-loss feeder; 4: screw feeder; 5: Venturi dryer; 6: first cyclone preheater; 7: second cyclone preheater; 8: pre-oxidation suspension roasting furnace; 9-1: main burner; 9-2: first additional burner; 9-3: second additional burner; 10: thermal separation cyclone cylinder; 11: first flow sealing valve; 12: suspension and reduction roasting furnace; 13: cyclone separator; 14: second flow sealing valve; 15: first cooling cyclone cylinder; 16: second cooling cyclone cylinder; 17: third cooling cyclone cylinder; 18: collecting bin; 19: grinding machine; 20: magnetic ore separator; 21: iron ore concentrate collector; 22: manganese ore concentrate collector; 23: dust collector; 24: air slider; 25: chain bucket elevator; 26: draught fan; 27: chimney; 28: gas; 29: coal gas source; 30: nitrogen gas source; and 31: air.

The structure of a suspension roasting system for industrial processing of iron and manganese ores is shown as FIG. 1, and the system comprises a feeding belt 1, a feeding bin 2, a weight-loss feeder 3, a screw feeder 4, a Venturi dryer 5, a first cyclone preheater 6, a second cyclone preheater 7, a pre-oxidation suspension roasting furnace 8, a thermal separation cyclone cylinder 10, a first flow sealing valve 11, a suspension and reduction roasting furnace 12, a cyclone separator 13, a second flow sealing valve 14, a first cooling cyclone cylinder 15, a second cooling cyclone cylinder 16, a third cooling cyclone cylinder 17, a collecting bin 18, a grinding machine 19, magnetic ore separator 20, an iron ore concentrate collector 21, a manganese ore concentrate collector 22, a dust collector 23, an air slider 24, a chain bucket elevator 25, a draught fan 26, a chimney 27, a coal gas source 29 and a nitrogen gas source 30.

The feeding belt 1 is arranged above the feeding bin 2 to convey dust ores to the feeding bin 2. The weight-loss feeder 3 is arranged between the feeding bin 2 and the screw feeder 4, and is respectively opposite to an outlet of the feeding bin 2 and a feeding end of the screw feeder 4, and a discharging end of the screw feeder 4 is opposite to a feed opening of the Venturi dryer 5.

A discharge opening of the Venturi dryer 5 communicates with a feed opening of the first cyclone preheater 6, a discharge opening of the first cyclone preheater 6 communicates with a feed opening of the second cyclone preheater 7, a discharge opening of the second cyclone preheater 7 communicates with a feed opening in a lower part of the pre-oxidation suspension roasting furnace 8, a burner and an air inlet are formed in a bottom part of the pre-oxidation suspension roasting furnace 8. An upper part of the pre-oxidation suspension roasting furnace 8 communicates with a first feed opening of the thermal separation cyclone cylinder 10 through a first pipeline, a discharge opening of the thermal separation cyclone cylinder 10 communicates with an inlet of the first flow sealing valve 11, an outlet of the first flow sealing valve 11 communicates with a first feed opening in a top part of the suspension and reduction roasting furnace 12, and a plurality of air inlets are formed in a bottom part of the suspension and reduction roasting furnace 12 and simultaneously communicate with the coal gas source 29 and the nitrogen gas source 30.

A discharge opening in a side part of the suspension and reduction roasting furnace 12 communicates with an inlet of the second flow sealing valve 14, an outlet of the second flow sealing valve 14 communicates with a feed opening of the first cooling cyclone cylinder 15, a discharge opening of the first cooling cyclone cylinder 15 communicates with a feed opening of the second cooling cyclone cylinder 16, a discharge opening of the second cooling cyclone cylinder 16 communicates with a feed opening of the third cooling cyclone cylinder 17, and a discharge opening of the third cooling cyclone cylinder 17 communicates with an inlet of the collecting bin 18.

An outlet of the collecting bin 18 cooperates with an inlet of the grinding machine 19, and an outlet of the grinding machine 19 cooperates with a feed opening of the magnetic ore separator 20. An air outlet of the first cyclone preheater 6 communicates with an air inlet of the dust collector 23, and an air outlet of the dust collector 23 communicates with the draught fan 26.

A discharge opening of the dust collector 23 is opposite to the air slider 24, a discharge opening of the air slider 24 is opposite to an inlet of the chain bucket elevator 25, and an outlet of the chain bucket elevator 25 communicates with a second feed opening of the thermal separation cyclone cylinder 10. An air outlet of the thermal separation cyclone cylinder 10 communicates with the feed opening of the second cyclone preheater 7. An air outlet of the second cyclone preheater 7 communicates with an air inlet in a bottom part of the Venturi dryer 5 through a second pipeline, a second additional burner 9-3 is arranged on the second pipeline, and the second additional burner 9-3 communicates with the coal gas source 29.

An exhaust opening is formed in the top part of the suspension and reduction roasting furnace 12 and communicates with a feed opening in a bottom part of the cyclone separator 13, an air outlet of the cyclone separator 13 communicates with the feed opening in the lower part of the pre-oxidation suspension roasting furnace 8, and a discharge opening of the cyclone separator 13 communicates with a second feed opening in the top part of the suspension and reduction roasting furnace 12.

An air outlet of the third cooling cyclone cylinder 17 communicates with the feed opening of the second cooling cyclone cylinder 16, an air outlet of the second cooling cyclone cylinder 16 communicates with the feed opening of the first cooling cyclone cylinder 15, an air outlet of the first cooling cyclone cylinder 15 communicates with the air inlet in the bottom part of the pre-oxidation suspension roasting furnace 8, and an air inlet of the third cooling cyclone cylinder 17 is provided with an air pipeline for inflation of air 31.

The burner arranged at the bottom part of the pre-oxidation suspension roasting furnace 8 consists of a main burner 9-1 and a first additional burner 9-2, and the main burner 9-1 and the first additional burner 9-2 respectively communicate with the coal gas source 29.

An outlet of the draught fan 26 communicates with the chimney 27.

A magnetic product outlet of the magnetic ore separator 20 is opposite to the iron ore concentrate collector 21 and a nonmagnetic product outlet of the magnetic ore separator 20 is opposite to the manganese ore concentrate collector 22.

An iron grade TFe of iron and manganese ores is 41.56%, and a manganese grade TMn of iron and manganese ores is 15.68%. A suspension roasting method for industrial processing of iron and manganese ores comprises the following steps:

Crushing iron and manganese ores until a total mass of a part with a grain size of 1 mm accounts for 80% of a total mass to obtain dust ores.

Conveying the dust ores to the feeding bin 2 through the feeding belt 1, continuously feeding the dust ores in the feeding bin 2 to the screw feeder 4 through the weight-loss feeder 3, and continuously feeding the dust ores into the Venturi dryer 5 through the screw feeder 4.

Starting the draught fan 26 to enable the dust collector 23, the first cyclone preheater 6, the second cyclone preheater 7, the Venturi dryer 5, the thermal separation cyclone cylinder 10 and the pre-oxidation suspension roasting furnace 8 to generate negative pressure, inflating combustion gas into the Venturi dryer 5, mixing the combustion gas with the dust ores, and removing adsorbing water of the dust ores; controlling a material temperature of the discharge opening of the Venturi dryer 5 to be 150° C.

Enabling the combustion gas and the dust ores without the adsorbing water to enter the first cyclone preheater 6 from the Venturi dryer 5, enabling solid materials after cyclonic separation to enter the second cyclone preheater 7, preheating the solid materials after cyclonic separation for the second time in the second cyclone preheater 7 to 400° C., and then enabling the preheated solid materials to enter the pre-oxidation suspension roasting furnace 8.

After the dust ores enter the first cyclone preheater 6, exhausting separated gas from the first cyclone preheater 6, enabling the exhausted gas to enter the dust collector 23, and enabling the gas after dust removal into the draught fan 26; exhausting gas 28 exhausted by the draught fan 26 through the chimney 27.

After dust generated during dust removal is discharged, enabling the dust to enter the chain bucket elevator 25 through the air slider 24; conveying the dust to the thermal separation cyclone cylinder 10 through the chain bucket elevator 25; inflating the gas separated by the thermal separation cyclone cylinder 10 in a cyclonic separation process into the second cyclone preheater 7; inflating the gas separated by the second cyclone preheater 7 in a cyclonic separation process to enter the Venturi dryer 5 through the second pipeline; and enabling the second additional burner 9-3 arranged on the second pipeline to inflate the combustion gas into the Venturi dryer 5 at the same time.

Starting the burner to burn inflated coal gas to generate high-temperature gas to enter the pre-oxidation suspension roasting furnace 8, while inflating air 31 into the pre-oxidation suspension roasting furnace 8 through the air inlet in the bottom part of the pre-oxidation suspension roasting furnace 8, under an action of air flow and negative pressure, enabling the solid materials in the pre-oxidation suspension roasting furnace 8 to be in a suspension state, heating the solid materials to 550° C. for roasting, enabling carbonate minerals in the solid materials to be subjected to thermal decomposition, and enabling manganese minerals and iron minerals to be subjected to an oxidizing reaction; enabling all roasted solid materials to be discharged from the upper part of the pre-oxidation suspension roasting furnace 8 along with the air flow through the first pipeline to enable the solid materials to enter the thermal separation cyclone cylinder 10; using the solid materials after cyclonic separation as oxidizing slag powder, discharging the solid materials from the thermal separation cyclone cylinder 10, and enabling the discharged solid materials to enter the suspension and reduction roasting furnace 12 through the first flow sealing valve 11; and wherein a residence time of the solid materials entering the pre-oxidation suspension roasting furnace 8, in the pre-oxidation suspension roasting furnace 8 is 300 seconds.

The burner arranged at the bottom part of the pre-oxidation suspension roasting furnace 8 consists of the main burner 9-1 and the first additional burner 9-2, and coal gas is inflated into the main burner 9-1 and the first additional burner 9-2 through the coal gas source 29.

Inflating the coal gas and nitrogen gas from the air inlets in the bottom part of the suspension and reduction roasting furnace 12 through the coal gas source 29 and the nitrogen gas source 30, enabling the oxidizing slag powder to be in a suspension state under an action of the air flow and the negative pressure, performing reducing roasting at 500° C., performing reduction on weakly magnetic $Fe_2O_3$ to generate strongly magnetic $Fe_3O_4$, and performing reduction on $Mn_2O_3$ to generate MnO; using the solid materials after reducing roasting as reducing slag powder, and discharging the reducing slag powder from the side part of the suspension and reduction roasting furnace 12, and wherein a residence time of oxidizing slag powder in the suspension and reduction roasting furnace 12 is 70 minutes.

When the coal gas and the nitrogen gas are inflated from the air inlets in the bottom part of the suspension and reduction roasting furnace 12, the inflation amount of the coal gas is 1.1 times of a theoretically required amount for a complete reaction between $H_2$/CO in the coal gas and $Fe_2O_3$ and $Mn_2O_3$ in the oxidizing slag powder, and besides, a volume concentration of the coal gas in the pre-oxidation suspension roasting furnace 8 is controlled to be 40%.

Inflating gas generated by the suspension and reduction roasting furnace 12 in a reducing roasting process into the cyclone separator 13 from the exhaust opening in the top part of the suspension and reduction roasting furnace 12, enabling the dust separated by the cyclone separator 13 to return to the suspension and reduction roasting furnace 12 through the second feed opening in the top part of the suspension and reduction roasting furnace 12, and inflating the separated gas by the cyclone separator 13 into the feed opening in the lower part of the pre-oxidation suspension roasting furnace 8.

Enabling the reducing slag powder discharged from the suspension and reduction roasting furnace 12 to sequentially pass through the first cooling cyclone cylinder 15, the second cooling cyclone cylinder 16 and the third cooling cyclone cylinder 17 after entering the second flow sealing valve 14, performing cooling the reducing slag powder to be smaller than or equal to 200° C., and enabling the cooled reducing slag powder to enter the collecting bin 18.

Inflating the gas separated by the third cooling cyclone cylinder 17 in a cyclonic separation process into the feed opening of the second cooling cyclone cylinder 16, inflating the gas separated by the second cooling cyclone cylinder 16 in a cyclonic separation process into the feed opening of the first cooling cyclone cylinder 15, inflating the gas separated by the first cooling cyclone cylinder 15 in a cyclonic separation process into the air inlet in the bottom part of the pre-oxidation suspension roasting furnace 8, while inflating air 31 through the air inlet of the third cooling cyclone cylinder 17.

Conveying the reducing slag powder in the collecting bin 18 to the grinding machine 19, performing grinding until a part with a grain size of 0.074 mm accounts for 75% of a total mass, and enabling the ground powder to enter the magnetic ore separator 20 for magnetic ore separation, wherein magnetic field strength during magnetic separation is 2000 Oe, the magnetic products separated by magnetic ore separation are used as iron ore concentrates, the nonmagnetic products separated by magnetic ore separation are used as manganese ore concentrates, the magnetic products separated by magnetic ore separation enter the iron ore concentrate collector 21, the nonmagnetic products separated by magnetic ore separation enter the manganese ore concentrate collector 22, and the iron ore concentrates have a TFe grade of 67.18%, and the manganese ore concentrates have a TMn grade of 50.30%.

Embodiment 2

The structure of a suspension roasting system for industrial processing of iron and manganese ores is the same as that in embodiment 1.

The iron grade TFe of the iron and manganese ores is 43.87%, and the manganese grade TMn of the iron and manganese ores is 23.51%. The method is the same as that of embodiment 1, and has the following differences from the embodiment 1:

(1) Crushing the iron and manganese ores until a part with the grain size of 1 mm accounts for 85% of the total mass.

(2) Controlling the material temperature of the discharge opening of the Venturi dryer 5 to 160° C., and preheating the solid materials in the second cyclone preheater 7 to 550° C.

(3) Preheating the solid materials in the pre-oxidation suspension roasting furnace 8 to 700° C. for roasting, and wherein the residence time of the solid materials in the pre-oxidation suspension roasting furnace 8 is 180 seconds.

(4) Controlling the reducing roasting temperature to 600° C., wherein the residence time of oxidizing slag powder in the suspension and reduction roasting furnace 12 is 30 minutes, the inflation amount of the coal gas is 1.2 times of the theoretically required amount for the complete reaction between $H_2$/CO in the coal gas and $Fe_2O_3$ and $Mn_2O_3$ in the oxidizing slag powder, and the volume concentration of the coal gas in the pre-oxidation suspension roasting furnace 8 is controlled to be 30%.

(5) Grinding reducing slag powder until a part with the grain size of 0.074 mm accounts for 80% of the total mass, wherein magnetic field strength during magnetic separation is 1500 Oe, the iron ore concentrates have a TFe grade of 65.2%, and the manganese ore concentrates have a TMn grade of 45.51%.

Embodiment 3

The structure of a suspension roasting system for industrial processing of iron and manganese ores is the same as that in embodiment 1;

The iron grade TFe of the iron and manganese ores is 39.62%, and the manganese grade TMn of the iron and manganese ores is 19.38%. The method is the same as that of embodiment 1, and has the following difference from the embodiment 1:

(1) Crushing the iron and manganese ores until a part with the grain size of 1 mm accounts for 90% of the total mass.

(2) Controlling the material temperature of the discharge opening of the Venturi dryer 5 to 180° C., and preheating the solid materials in the second cyclone preheater 7 to 700° C.

(3) Preheating the solid materials in the pre-oxidation suspension roasting furnace 8 to 900° C. for roasting, and wherein the residence time of the solid materials in the pre-oxidation suspension roasting furnace 8 is 60 seconds.

(4) Controlling the reducing roasting temperature to 650° C., wherein the residence time of oxidizing slag powder in the suspension and reduction roasting furnace 12 is 10 minutes, the inflation amount of the coal gas is 1.3 times of the theoretically required amount for the complete reaction between $H_2$/CO in the coal gas and $Fe_2O_3$ and $Mn_2O_3$ in the oxidizing slag powder, and the volume concentration of the coal gas in the pre-oxidation suspension roasting furnace 8 is controlled to be 20%; and (5) Grinding reducing slag powder until a part with the grain size of 0.074 mm accounts for 85% of the total mass, wherein magnetic field strength during magnetic separation is 1000 Oe, the iron ore concentrates have a TFe grade of 66.4%, and the manganese ore concentrates have a TMn grade of 47.9%.

What is claimed is:

1. A suspension roasting method for industrial processing of iron and manganese ores for a suspension roasting system for industrial processing of iron and manganese ores, the system comprising a feeding bin, a screw feeder, a Venturi dryer, a first cyclone preheater, a second cyclone preheater, a pre-oxidation suspension roasting furnace, a thermal separation cyclone cylinder, a first flow sealing valve, a suspension and reduction roasting furnace, a second flow sealing valve, a first cooling cyclone cylinder, a second cooling cyclone cylinder, a third cooling cyclone cylinder, a collecting bin, a grinding machine, a magnetic ore separator, a dust collector, a draught fan, a coal gas source and a nitrogen gas source;

wherein an outlet of the feeding bin is opposite to a feeding end of the screw feeder, and a discharging end of the screw feeder is opposite to a feed opening of the Venturi dryer;

wherein a discharge opening of the Venturi dryer communicates with a feed opening of the first cyclone preheater, a discharge opening of the first cyclone preheater communicates with a feed opening of the second cyclone preheater, a discharge opening of the second cyclone preheater communicates with a feed opening in a lower part of the pre-oxidation suspension roasting furnace, and a burner and an air inlet are arranged in a bottom part of the pre-oxidation suspension roasting furnace;

wherein an upper part of the pre-oxidation suspension roasting furnace communicates with a first feed opening of the thermal separation cyclone cylinder through a first pipeline, a discharge opening of the thermal separation cyclone cylinder communicates with an inlet of the first flow sealing valve, an outlet of the first flow sealing valve communicates with a first feed opening in a top part of the suspension and reduction roasting furnace, and a plurality of air inlets are formed in a bottom part of the suspension and reduction roasting furnace and simultaneously communicate with the coal gas source and the nitrogen gas source;

wherein a discharge opening in a side part of the suspension and reduction roasting furnace communicates with an inlet of the second flow sealing valve, an outlet of the second flow sealing valve communicates with a feed opening of the first cooling cyclone cylinder, a discharge opening of the first cooling cyclone cylinder communicates with a feed opening of the second cooling cyclone cylinder, a discharge opening of the second cooling cyclone cylinder communicates with a feed opening of the third cooling cyclone cylinder, and a discharge opening of the third cooling cyclone cylinder communicates with an inlet of the collecting bin;

wherein an outlet of the collecting bin cooperates with an inlet of the grinding machine, and an outlet of the grinding machine cooperates with a feed opening of the magnetic ore separator;

wherein an air outlet of the first cyclone preheater communicates with an air inlet of the dust collector, and an air outlet of the dust collector communicates with the draught fan;

wherein an air outlet of the third cooling cyclone cylinder communicates with the feed opening of the second cooling cyclone cylinder, an air outlet of the second cooling cyclone cylinder communicates with the feed opening of the first cooling cyclone cylinder, an air outlet of the first cooling cyclone cylinder communicates with the air inlet in the bottom part of the pre-oxidation suspension roasting furnace, and an air inlet of the third cooling cyclone cylinder is provided with an air pipeline for inflation of air;

the method comprising the following steps:

(1) crushing iron and manganese ores until a total mass of a part with a grain size of 1 mm being greater than or equal to 80% to obtain dust ores, wherein an iron grade TFe of the iron and manganese ores is 30-55%, and a manganese grade TMn of the iron and manganese ores is 10-30%;

(2) placing the dust ores in the feeding bin, then conveying the dust ores into the screw feeder, and continuously feeding the dust ores into the Venturi dryer through the screw feeder;

(3) starting the draught fan and generating negative pressure by the dust collector, the first cyclone preheater, the second cyclone preheater, the Venturi dryer, the thermal separation cyclone cylinder and the pre-oxidation suspension roasting furnace, introducing combustion gas into the Venturi dryer, mixing the combustion gas with the dust ores, and removing adsorbing water of the dust ores; controlling a material temperature of the discharge opening of the Venturi dryer to be 150-180° C.;

(4) introducing the combustion gas and the dust ores without the adsorbing water to enter the first cyclone preheater from the Venturi dryer, introducing solid materials after cyclonic separation to the second cyclone preheater, preheating the solid materials after cyclonic separation for the second time in the second cyclone preheater to 400-700° C., and then introducing the preheated solid materials to the pre-oxidation suspension roasting furnace;

(5) starting the burner to burn introduced coal gas to generate high-temperature gas to enter the pre-oxidation suspension roasting furnace, while introducing air into the pre-oxidation suspension roasting furnace through the air inlet in the bottom part of the pre-oxidation suspension roasting furnace, under an action of air flow and negative pressure, so that the solid materials in the pre-oxidation suspension roasting furnace is in a suspension state, heating the solid materials to 550-900° C. for roasting, so that carbonate minerals in the solid materials is subjected to thermal decomposition, and manganese minerals and iron minerals is subjected to an oxidizing reaction; discharging all roasted solid materials from the upper part of the pre-oxidation suspension roasting furnace along with the air flow through the first pipeline to introduce the solid materials to the thermal separation cyclone cylinder; using the solid materials after cyclonic separation as oxidizing slag powder including $Fe_2O_3$ and $Mn_2O_3$, discharging the solid materials from the thermal separation cyclone cylinder, and introducing the discharged solid materials the suspension and reduction roasting furnace through the first flow sealing valve;

(6) introducing the coal gas and nitrogen gas from the air inlets in the bottom part of the suspension and reduction roasting furnace, so that the oxidizing slag powder is in a suspension state under an action of the air flow and the negative pressure, performing reducing roasting at 500-650° C., performing reduction on weakly magnetic $Fe_2O_3$ to generate strongly magnetic $Fe_3O_4$, and performing reduction on $Mn_2O_3$ to generate MnO; using the solid materials after reducing roasting as reducing slag powder, and discharging the reducing slag powder from the side part of the suspension and reduction roasting furnace;

(7) sequentially passing the reducing slag powder discharged from the suspension and reduction roasting furnace through the first cooling cyclone cylinder, the second cooling cyclone cylinder and the third cooling cyclone cylinder after entering the second flow sealing valve, performing cooling the reducing slag powder in a temperature less than or equal to 200° C., introducing the cooled reducing slag powder to the collecting bin, introducing the gas separated by the third cooling cyclone cylinder in a cyclonic separation process into the feed opening of the second cooling cyclone cylinder, introducing the gas separated by the second cooling cyclone cylinder in a cyclonic separation process into the feed opening of the first cooling cyclone cylinder, and introducing the gas separated by the first cooling cyclone cylinder in a cyclonic separation process into the air inlet in the bottom part of the pre-oxidation suspension roasting furnace, while introducing air through an air inlet of the third cooling cyclone cylinder; and (8) conveying the reducing slag powder in the collecting bin to the grinding machine, performing grinding until a part with a grain size of 0.074 mm accounts for 75-85% of a total mass, introducing the ground powder to the magnetic ore separator for magnetic ore separation, and using magnetic products obtained by magnetic ore separation as iron ore concentrates and nonmagnetic products obtained by magnetic ore separation as manganese ore concentrates.

2. The method according to claim 1, wherein the system further comprises a weight-loss feeder; wherein the weight-loss feeder is arranged between the feeding bin and the screw feeder, and is respectively opposite to the outlet of the feeding bin and the feeding end of the screw feeder.

3. The method according to claim 1, wherein the system further comprises an air slider and a chain bucket elevator; wherein a discharge opening of the dust collector is opposite to the air slider, a discharge opening of the air slider is opposite to an inlet of the chain bucket elevator, and an outlet of the chain bucket elevator communicates with a second feed opening of the thermal separation cyclone cylinder; wherein an air outlet of the thermal separation cyclone cylinder communicates with the feed opening of the second cyclone preheater; and wherein an air outlet of the second cyclone preheater communicates with an air inlet in a bottom part of the Venturi dryer through a second pipeline, a second additional burner is arranged on the second pipeline, and the second additional burner communicates with the coal gas source.

4. The method according to claim 1, wherein the system further comprises a cyclone separator; wherein an exhaust opening is formed in the top part of the suspension and reduction roasting furnace and communicates with a feed opening in a bottom part of the cyclone separator, an air outlet of the cyclone separator communicates with the feed opening in the lower part of the pre-oxidation suspension roasting furnace, and a discharge opening of the cyclone separator communicates with a second feed opening in the top part of the suspension and reduction roasting furnace.

5. The method according to claim 1, wherein the burner arranged at the bottom part of the pre-oxidation suspension roasting furnace consists of a main burner and a first additional burner; and wherein the main burner and the first additional burner respectively communicate with the coal gas source.

6. The method according to claim 1, wherein step (4) further comprises the following steps; after the dust ores enter the first cyclone preheater, exhausting separated gas from the first cyclone preheater, introducing the exhausted gas to the dust collector, and introducing the gas after dust removal into the draught fan; after dust generated during dust removal is discharged, enabling the dust to enter a chain bucket elevator through an air slider; conveying the dust to the thermal separation cyclone cylinder through the chain bucket elevator; introducing the gas separated by the thermal separation cyclone cylinder in a cyclonic separation process into the second cyclone preheater; introducing the gas separated by the second cyclone preheater in a cyclonic separation process to enter the Venturi dryer through a second pipeline; and introducing a second additional burner arranged on the second pipeline to the combustion gas into the Venturi dryer at the same time.

7. The method according to claim 1, wherein step (6) further comprises the following steps; introducing gas generated by the suspension and reduction roasting furnace in a reducing roasting process into a cyclone separator from an exhaust opening in the top part of the suspension and reduction roasting furnace, returning the dust separated by the cyclone separator to the suspension and reduction roasting furnace through a second feed opening in the top part of the suspension and reduction roasting furnace, and introducing the separated gas by the cyclone separator into the feed opening in the lower part of the pre-oxidation suspension roasting furnace.

* * * * *